US011395539B2

(12) United States Patent
Stanton

(10) Patent No.: US 11,395,539 B2
(45) Date of Patent: Jul. 26, 2022

(54) HAIR BRUSHING DEVICE

(71) Applicant: DMS Innovations Limited, Grappenhall (GB)

(72) Inventor: Deane Marc Stanton, Runcorn (GB)

(73) Assignee: DMS Innovations Limited, Grappenhall (GB)

( * ) Notice: Subject to any disclaimer, the term of this patent is extended or adjusted under 35 U.S.C. 154(b) by 199 days.

(21) Appl. No.: 14/421,605

(22) PCT Filed: Sep. 4, 2013

(86) PCT No.: PCT/GB2013/000372
§ 371 (c)(1),
(2) Date: Feb. 13, 2015

(87) PCT Pub. No.: WO2014/037693
PCT Pub. Date: Mar. 13, 2014

(65) Prior Publication Data

US 2015/0189979 A1 Jul. 9, 2015

(30) Foreign Application Priority Data

Sep. 4, 2012 (GB) ..... 1215724

(51) Int. Cl.

| | |
|---|---|
| ***A46B 9/02*** | (2006.01) |
| ***A46B 5/02*** | (2006.01) |
| ***A46B 7/04*** | (2006.01) |
| ***A45D 24/04*** | (2006.01) |

(52) U.S. Cl.
CPC ..... *A46B 9/023* (2013.01); *A46B 5/021* (2013.01); *A46B 7/04* (2013.01); *A46B 7/042* (2013.01); *A45D 24/04* (2013.01); *A46B 2200/102* (2013.01)

(58) Field of Classification Search
CPC ..... A46B 5/026; A46B 5/0033; A46B 7/02; A46B 9/04; A46B 5/0008; A46B 17/04; A47L 23/05
USPC ..... 15/106, 167.1, 110, 159.1
See application file for complete search history.

(56) References Cited

U.S. PATENT DOCUMENTS

| | | | | |
|---|---|---|---|---|
| 1,166,296 | A * | 12/1915 | Wolfe et al. | A46B 5/0033 15/185 |
| 1,765,065 | A * | 6/1930 | Fear | A47L 23/05 15/258 |
| 2,618,006 | A * | 11/1952 | Morris | A47L 23/05 15/258 |
| 2,668,972 | A * | 2/1954 | Pignato | A46B 17/08 15/172 |

(Continued)

FOREIGN PATENT DOCUMENTS

| | | | |
|---|---|---|---|
| GB | 1469552 | A | 4/1977 |
| KR | 20050011800 | A | 1/2005 |
| WO | WO 2005/094627 | A1 | 10/2005 |

OTHER PUBLICATIONS

International Search Report dated Jan. 3, 2014, for corresponding application No. PCT/GB2013/000372.

*Primary Examiner* — Laura C Guidotti
*Assistant Examiner* — Thomas Raymond Rodgers

(57) ABSTRACT

A hair brushing device comprises a housing and a brush, the brush body is formed from a rigid plastics material and is capable of being mounted, in a least two different positions, to allow variation in the functionality of a device of the type of the invention.

14 Claims, 4 Drawing Sheets

(56) References Cited

U.S. PATENT DOCUMENTS

| | | | | | |
|---|---|---|---|---|---|
| 2,764,770 | A * | 10/1956 | Frank | A46B 17/04 | 15/106 |
| 4,277,193 | A * | 7/1981 | Knaus | A46B 7/02 | 132/120 |
| 5,664,278 | A * | 9/1997 | Reisman | A46B 9/02 | 15/160 |
| 6,196,235 | B1 * | 3/2001 | Kim | A46B 5/0033 | 132/148 |
| 6,442,785 | B1 * | 9/2002 | Robinson | A46B 9/028 | 15/167.1 |
| 7,712,175 | B2 * | 5/2010 | Blanchard | A46B 5/026 | 15/106 |
| D702,046 | S * | 4/2014 | Zmrhal | D4/120 | |
| 2011/0056505 | A1 | 3/2011 | Parkinson et al. | | |
| 2011/0083292 | A1 | 4/2011 | Boyd | | |
| 2012/0198642 | A1 * | 8/2012 | Jossem | A46B 5/0008 | 15/106 |

* cited by examiner

HAIR BRUSHING DEVICE

RELATED APPLICATIONS

This application claims benefit and priority to UK patent application A Hair Brushing Device, GB 1215724.4, filed Sep. 4, 2012; and to PCT application PCT/GB2013/000372, filed Sep. 4, 2013 (published as WO2014/037693), which are incorporated in their entirety herein for all purposes.

The present invention relates to a hair brushing device, in particular it relates to a double sided hair brushing device.

Hair brushes exist in a wide range of styles and designs; each design tailored to carry out a certain function.

Different styles of hair brush may vary in a number of ways, each feature providing the hairbrush with unique qualities and suiting it to certain functions. In particular, the shape of the brush and the bristle material used may vary, some examples of bristle material being boar bristle, nylon or metal.

It is known from the prior art that hair brushes have been produced in a compact form, however these devices are optimised only for the function to which their style of bristle is targeted; this may be detangling, smoothing or volumising for example.

Handle-less military style brushes, generally comprising a circular piece of wood inset with natural bristles have been considered particularly beneficial for their compact nature; however again, due to the style of bristle incorporated they had been suited only for short hair styles such as those seen in the military.

In addition concerns have been raised about the shape of such compact devices, as the lack of a handle can prove troublesome, causing the user to lose grip on the device.

Some compact brushes have sought to incorporate a design which overcomes this issue; however this has proved restrictive, as the designs facilitate use only for those who are right handed. In addition there is still an issue associated with attaining a firm grip on the device during use.

Furthermore, compact brushes have been considered particularly restrictive due to their incorporation of only a single bristle style suited to a single function. For example, a detangling brush may be beneficial when hair is wet whilst a different brush style, for smoothing or volumising, may be required at other times.

As such users often find it necessary to carry more than one hair brush to meet their changing needs. This can be inconvenient given the amount of space required to house traditionally designed hair brushes, particularly when space is limited.

Accordingly, the applicant has developed a device which incorporates a reversible brush face, providing 2 different styles of hair brush, each with a different function, within a single device.

In addition the device provides a novel body shape which incorporates a textured surface, improving the ability of the user to effectively grip the device in an ambidextrous manner. This feature obviates the need to produce a mirror image device for left handed users whilst providing an improved grip on the device for all users.

Accordingly it is an object of the present invention to provide a hair brushing device which overcomes or minimises the issues identified previously.

Thus and in accordance with the present invention there is provided a hair brushing device comprising a housing and a brush face capable of being mounted relative to said housing; where the brush face has at least 2 surfaces, upon each of which project a plurality of bristles and where the brush face may be reoriented in the housing such that each of the surfaces may be used.

Preferably the brush comprises polypropylene and polycarbonate ABS plastics.

In its preferred form the first brush face carries out a detangling function and the second brush face carries out a finishing function, however, the brush faces may vary depending on the needs of the user.

The first brush face comprises at least three lengths of bristles, where said bristles are arranged in repeating, substantially parallel rows, and where there is a row of short bristles, followed by a row of mid-length bristles, followed by a row of long bristles and where said pattern of rows is repeated across the entirety of the brush face.

Preferably the bristles of the second brush face are provided in a uniform length and have a substantially spherical tip, providing a surface which massages the scalp and prevents damage to the hair.

Preferably, on the first brush face, the long bristles measure 15 mm, the mid-length bristles measure 9 mm and the short bristles measure 6 mm and on the second face the bristles uniformly measure 15 mm Preferably the brush face is composed from polypropylene or another suitably flexible plastics material and the bristles are moulded so as to be continuous with the surface of the brush face.

Most preferably the body of the hair brush is substantially symmetrical to allow the device to fit the hand of the user ambidextrously.

Preferably said symmetrical body is substantially figure of eight shaped with 2 planes of symmetry.

Most preferably, there is provided a textured surface on the brush body which provides the user with an improved grip during use.

There is also provided a mechanism for securing the brush face into the body portion whilst in use, where said mechanism comprises protrusions on the outer perimeter of the brush face which fit into corresponding depressions on the internal edge of the body and where the brush face can be easily removed and re-secured to provide the reversible functionality.

In addition there is provided a tab on at least one edge of the brush face, which fits into a corresponding depression on the edge of the body portion of the device, such that the plastic tab of the brush face overhangs the body portion to allow the user to remove the brush face from its housing easily.

Preferably the tab should overhang the brush body by substantially in the order of between 1 mm and 5 mm; particularly desirable is a tab overhang of 2.5 mm.

Preferably a recess is provided behind the tab when it is inserted into the brush body such that the user's finger can be used to grip the tab and remove the brush face from the brush body.

An embodiment of the invention will now be described with reference to the accompanying drawings, by way of example only.

FIG. 1*a* is a perspective view of the first brush face.

FIG. 1*b* is a perspective side of the second brush face.

In an embodiment of the present invention there is provided a body portion (10) comprising 2 individual pieces; an upper region (10*a*) and a separate lower portion (10*c*) which holds the reversible brush face (11).

The brush body (10) is composed of a rigid plastics material such as polycarbonate ABS plastics.

Figure 3:
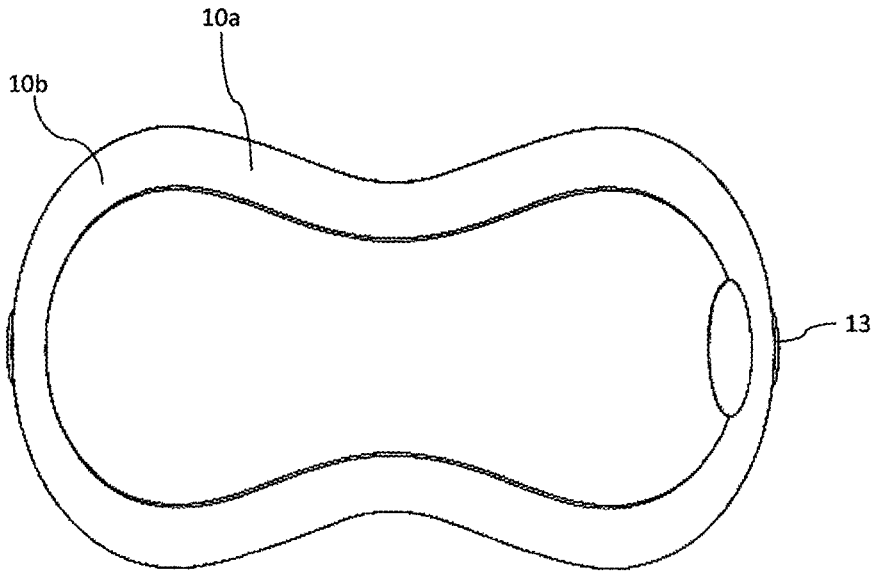
FIG. 3 is a plan view of the brush body.

As shown in the plan view in FIG. 3 the brush body (10) is substantially symmetrical and figure of eight shaped so as to fit the palm of the users hand in an ambidextrous manner. This removes the need to provide a mirror image brush for left handed users, thus cutting down the manufacturing costs.

The upper pal of the brush body (10*a*) has a distinct region (10*b*) which provides a textured surface such that the user can attain a better grip on the device when in use to obviate the problems identified with the prior art. This textured surface may be provided by during the moulding process.

Figure 2:
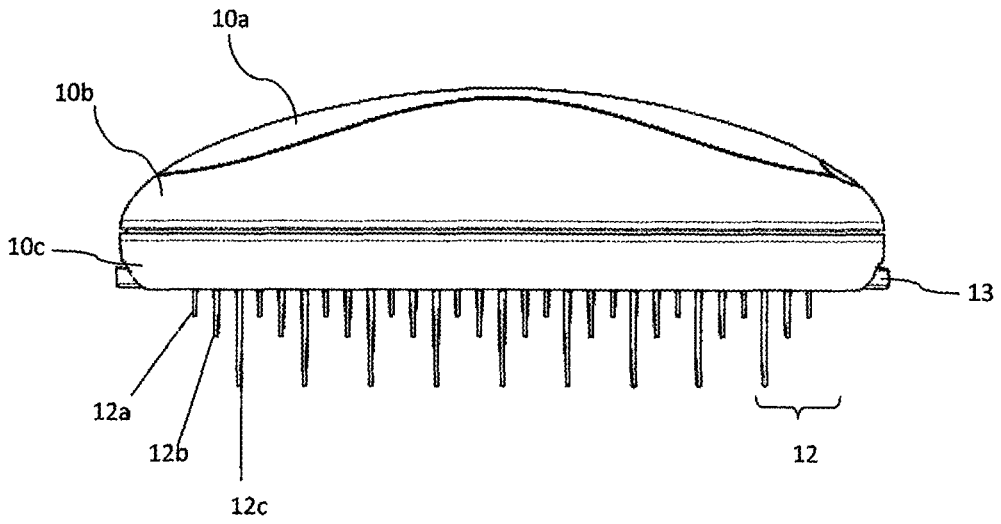
FIG. 2 is a side view of the first brush face.

The reversible brush face (11) has on its first face a plurality of bristles (12) which are provided in at least three distinct lengths; long (12*a*), mid-length (12*b*) and short (12*c*) where the length measurements are 15 mm, 9 mm and 6 mm respectively, as seen in FIG. 2.

The bristles (12) are arranged such that a row of short bristles (12*c*) is followed by a row of mid-length bristles (12*b*), followed by a row of long bristles (12*a*) and this pattern is repeated across the brush face.

Each row of bristles (12) is substantially parallel to the one preceding it.

The long bristles (12*a*) engage the lower layers of the hair, the mid length bristles (12*b*) engage the middle and upper sections of the hair and the short bristles (12*c*) engage the upper layer of the hair to carry out a smoothing function. As such the three lengths of bristles (12) allow the hair to be detangled without the need to section the hair first as was traditionally required, particularly to detangle the underneath of the hair.

Figure 1A:
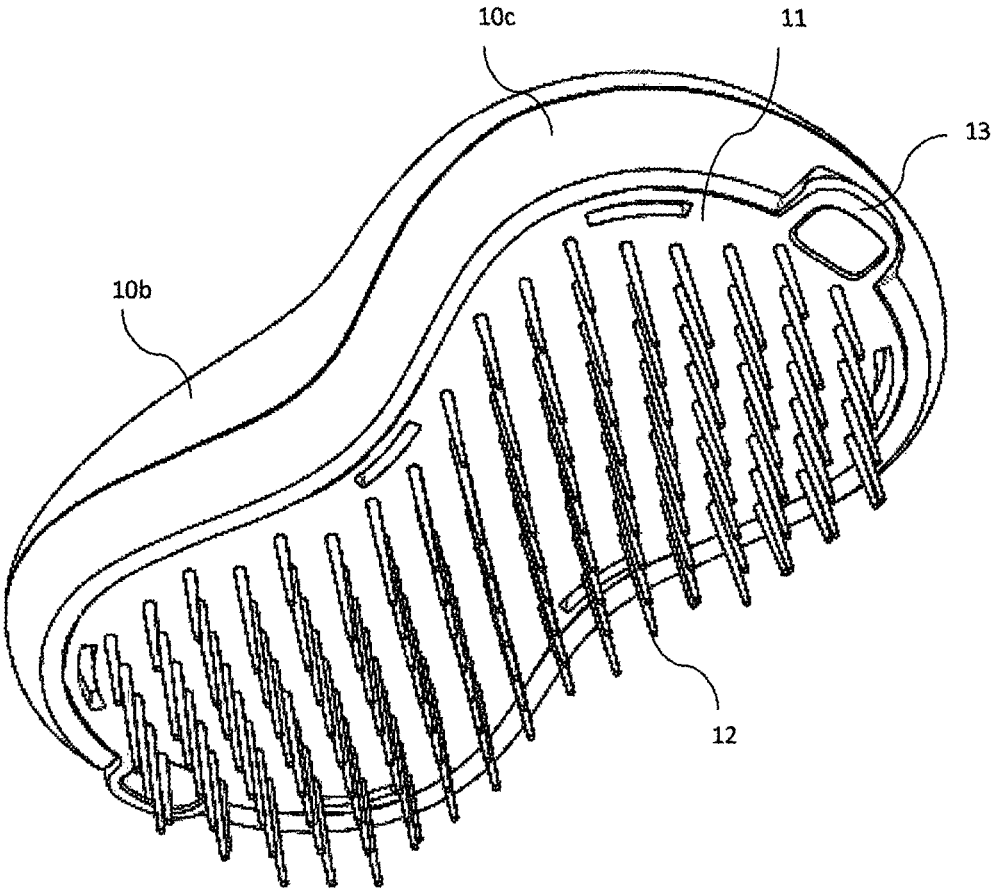
Figure 1B:
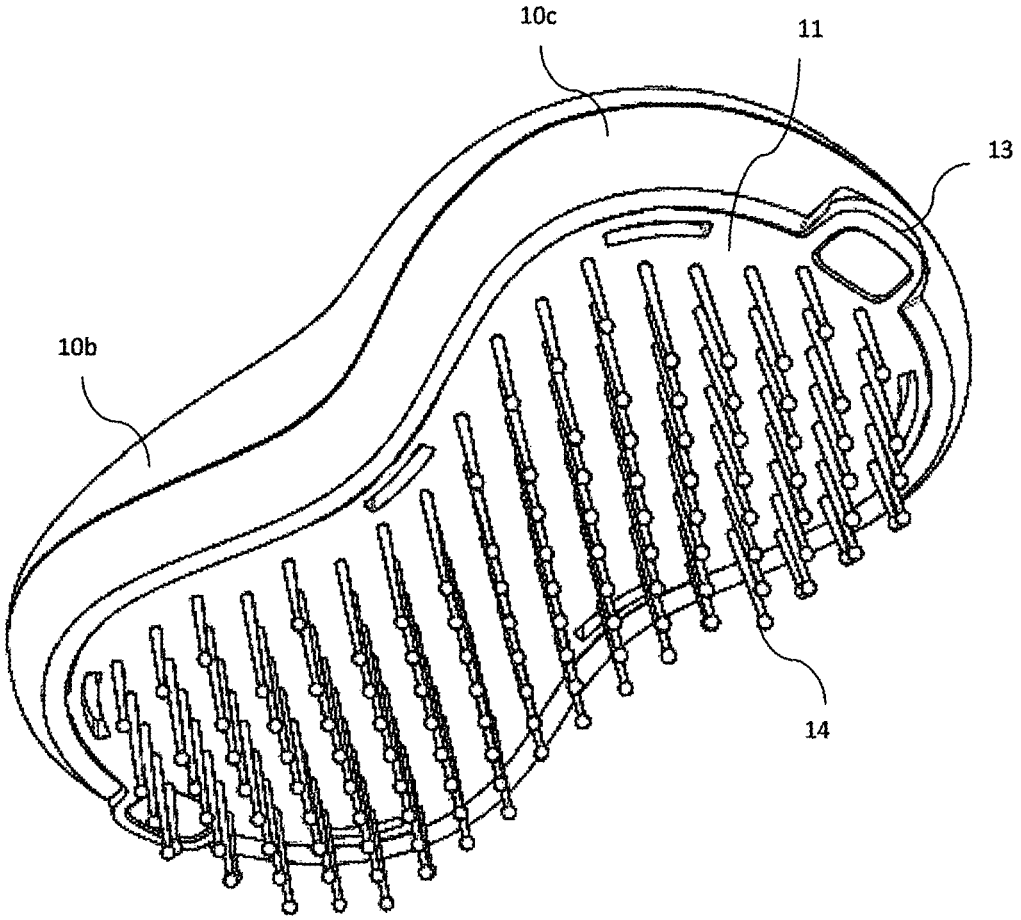

Additionally as shown in FIG. 1*b*, the reversible brush face (11) has a second brush face on which a plurality of bristles (14) are provided where said bristles have a substantially spherical portion at their external tip. The ball-tipped bristles (14) are provided in at least one uniform length.

The alternate bristles (14) are designed to carry out a finishing function for use when the detangling action is not required. The ball-tipped bristles (14) are particularly well suited to making straight hair styles sleek and smoothing fly aways as well as maintaining curled hair styles over extended periods of time. The ball-tipped bristles (14) additionally provide a scalp massaging action which can stimulate natural oil production and strengthen roots which may promote healthier hair.

The alternate bristles (14) are composed of polypropylene.

The bristles (14) on the second brush face are arranged in substantially parallel rows where there is a space of around 10 mm between each of the bristles (14) in each of said rows.

On both brush faces, each substantially parallel row is offset from the preceding row such that each bristle lies in a position between 2 bristles from the preceding row.

Both sets of bristles (12)(14) are composed of a substantially flexible plastics material, for example polypropylene such that the bristles will flex on encountering tangles in a manner which mimics the action of natural bristles (e.g. boar bristles), as these are known to be gentler and to minimise damage to the hair on brushing.

Figure 4:
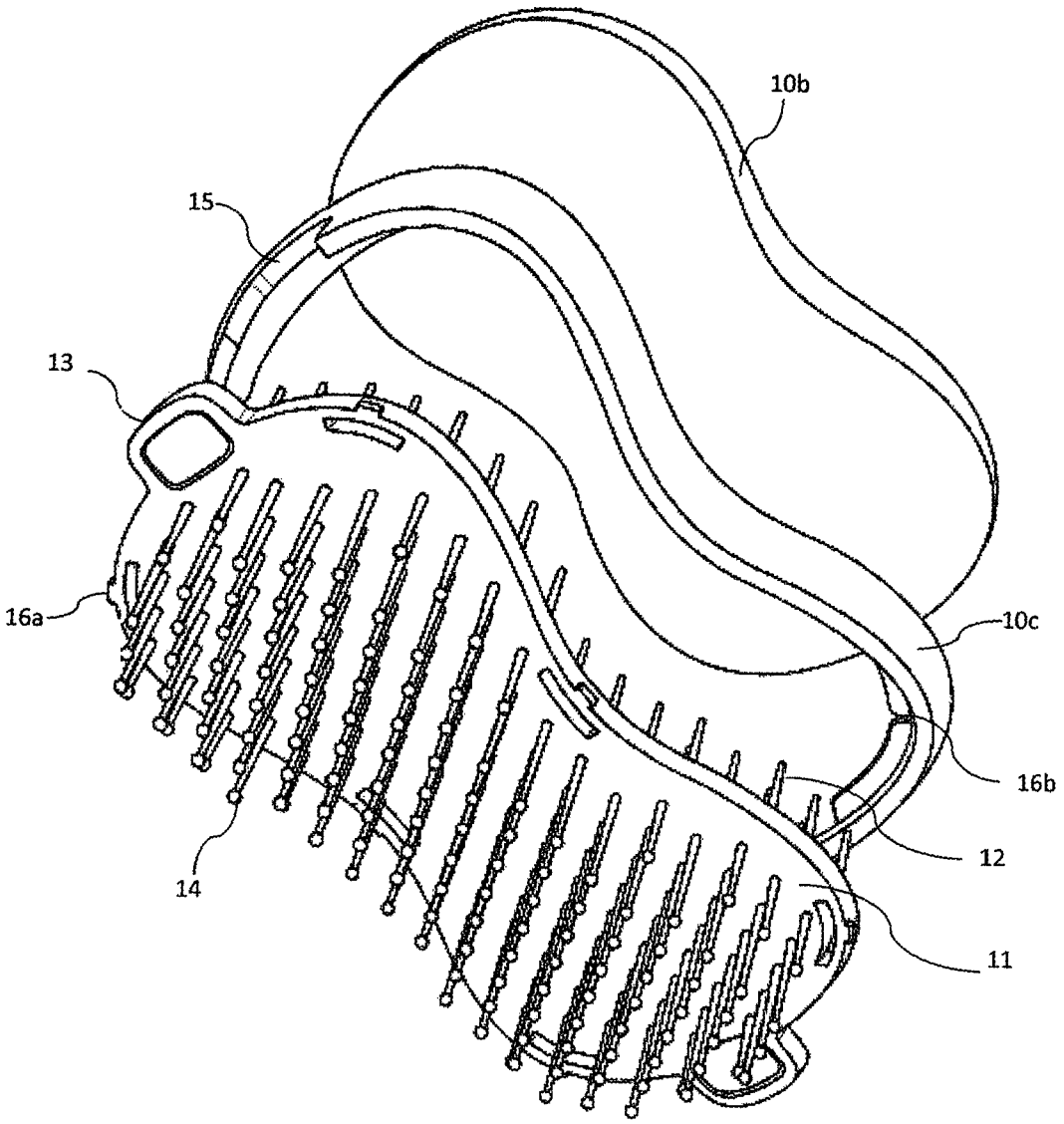
FIG. 4 is an exploded perspective view of the device.

As shown in the exploded view in FIG. 4, the reversible brush face (11) is non-permanently affixed to the body portion (10) by projections (16*a*) around the external perimeter of the brush face (11) which are inserted into corresponding depressions (16*b*) around the internal perimeter of the lower portion of the brush body (10*c*).

The reversible brush face (11) can be removed from the body portion (10) by a tab (13) which overhangs the body portion by 2.5 mm such that the user can easily remove the brush face from the brush body (10) as shown in FIG. 3. The overhanging tab (13) fits into a corresponding depression (15) in the lower portion of the brush body (10*c*).

When the brush face (11) is inserted into the brush body (10) and the tab (13) lies within its corresponding depression (15) there remains a recess behind the tab in order that the user may easily grip the tab (13) to further facilitate the removal of the reversible brush face (11) from the brush body (10).

It is to be understood that the invention is in no way limited to the details of the above embodiment which are provided by way of example only.

The invention claimed is:

1. A hair brushing device comprising:

a housing having an internal space therein; and a brush face comprising a first plurality of bristles extending from a first brush surface and a second plurality of bristles extending from a second brush surface;

wherein the first plurality of bristles or the second plurality of bristles has multiple lengths of bristles:

wherein, the brush face is releasably mounted to the housing;

wherein, when the brush face is mounted upon the housing, the first plurality of bristles are received within the internal space of the housing and the brush face is reversible on the housing to allowthe second plurality of bristles to face outwards from the housing;

wherein the brush face is configured to be reversible by completely removing the face from the housing and rotating the brush face so that the surface with the first plurality of bristles within the internal space then faces outwards from the housing;

wherein the housing in a plane parallel to the first surface of a mounted brush face has a length greater or width greater than a greatest depth of the housing perpendicular to the first surface;

wherein a mechanism for securing the brush face into a body portion of the housing is provided, wherein the mechanism comprises at least one protrusion on an outer perimeter of the brush face which can be received into corresponding depressions on an internal edge of the body portion;

wherein a tab is located on at least one edge of the brush face with the tab extended beyond the outer perimeter of the brush face so that, when attached to the housing, the tab overhangs the housing; and wherein the multiple lengths comprise one or more rows of mid-length bristles, one or more rows of relatively short bristles compared to the mid-length bristles, and one and one or more rows of relatively long bristles compared to the mid-length bristles.

2. The hair brush device according to claim 1, in which said first brush surface comprises multiple lengths of bristles extending therefrom.

3. The hair brush device according to claim 1, wherein a recess is provided in the housing adjacent to the tab.

4. The hair brush of claim 1, wherein the brush lacks a handle extending from the housing.

5. The hair brush of claim 1, wherein the housing is symmetrically indented.

6. The hair brush of claim 5, wherein the indentations are symmetrical in the plane parallel to the first surface.

7. The hair brush of claim 1, wherein the housing covers the brush face not facing outwards.

8. The hair brush of claim 1, wherein the brush face received within the internal space is covered by the housing.

9. The hair brush of claim 1, wherein the internal space is an enclosed space.

10. The hair brush of claim 1, wherein the brush lacks a handle.

11. The hair brush of claim 1, wherein starting with the first brush surface facing outwards from a first side of the housing, when the brush face is reversed the second brush surface faces outward from the first side of the housing.

12. The hair brush of claim 1, wherein the housing in the plane parallel to the first surface of the mounted brush face has the length greater and the width greater than the greatest depth of the housing perpendicular to the first surface.

13. The hair brush of claim 1, wherein said rotating comprises rotation of the brush face 180 degrees along an axis parallel to the plane parallel to the first surface.

14. The hair brush of claim 1, wherein the brush face is planar.

* * * * *